US009664472B1

(12) United States Patent
Kidd

(10) Patent No.: US 9,664,472 B1
(45) Date of Patent: May 30, 2017

(54) METHOD AND APPARATUS FOR SECURING A BARREL TO A RECEIVER OF A FIREARM

(71) Applicant: Anthony W. Kidd, McQueeney, TX (US)

(72) Inventor: Anthony W. Kidd, McQueeney, TX (US)

(73) Assignee: KIDD INNOVATIVE DESIGN, LLC, McQueeney, TX (US)

( * ) Notice: Subject to any disclaimer, the term of this patent is extended or adjusted under 35 U.S.C. 154(b) by 0 days.

(21) Appl. No.: 15/147,796

(22) Filed: May 5, 2016

Related U.S. Application Data

(60) Provisional application No. 62/157,176, filed on May 5, 2015.

(51) Int. Cl.
*F41A 21/48* (2006.01)
*F41A 3/66* (2006.01)
*F41A 19/10* (2006.01)

(52) U.S. Cl.
CPC ..... *F41A 21/485* (2013.01); *F41A 3/66* (2013.01); *F41A 19/10* (2013.01)

(58) Field of Classification Search
CPC ..... F41A 21/485; F41A 21/481; F41A 21/48
USPC ..... 42/75.01–75.04, 77, 71.01
See application file for complete search history.

(56) References Cited

U.S. PATENT DOCUMENTS 1,195,777 A * 8/1916 Burton ..... F41A 11/04 42/75.02
1,373,888 A * 4/1921 Johnson ..... F41A 21/482 42/75.02
5,907,919 A * 6/1999 Keeney ..... F41A 21/485 42/75.02
8,397,415 B2 * 3/2013 Laney ..... F42B 5/025 42/75.02

OTHER PUBLICATIONS

CZ-USA, www.cz-usa.com, Model CZ 455 American Combo, http://cz-usa.com/product/cz-455-american-combo-22-lr-17-hmr-5-rd-mags/ (May 2016).
Animation showing the steps to take off the barrel of a Model CZ 455 American Combo, https://www.youtube.com/watch?v=7-eHWcvT8NA (May 2016).

* cited by examiner

*Primary Examiner* — Reginald Tillman, Jr.
(74) *Attorney, Agent, or Firm* — Taboada Law Firm, PLLC; John M. Taboada

(57) ABSTRACT

Methods and apparatuses for securing a barrel to a receiver are disclosed, including inserting the barrel into the receiver, wherein the receiver comprises a bore with three or more guiding surfaces, one or more threaded securing holes, and a receiver indexing flat and wherein the barrel comprises: a tenon, one or more anchor points, and a barrel indexing flat; making contact between the tenon and the three or more guiding surfaces of the bore; indexing the barrel indexing flat with the receiver indexing flat; threading one or more securing screws into the one or more threaded securing holes; and tightening the one or more securing screws onto the one or more anchor points in order to secure the tenon of the barrel against two of the three or more guiding surfaces. Other embodiments are described and claimed.

18 Claims, 6 Drawing Sheets

METHOD AND APPARATUS FOR SECURING A BARREL TO A RECEIVER OF A FIREARM

I. CROSS REFERENCE TO RELATED APPLICATIONS

This application claims the benefit of the filing date of U.S. Provisional Patent Application Ser. No. 62/157,176, filed on May 5, 2015, entitled "Firearm," the entire disclosure of which is hereby incorporated by reference into the present disclosure.

II. BACKGROUND

The invention relates generally to firearms. More particularly, the invention relates to an innovative system for joining a barrel to the receiver of a firearm.

III. SUMMARY

In one respect, disclosed is a firearm comprising: a stock; a receiver, wherein the receiver comprises a bore with three or more guiding surfaces, one or more threaded securing holes, a threaded takedown screw hole, and a receiver indexing flat; a trigger unit removably attached to the receiver; a barrel removably attached to the receiver; wherein the barrel comprises: a tenon, one or more anchor points, and a barrel indexing flat; one or more securing screws; and a takedown screw; wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, and wherein the takedown screw threaded and tightened into the threaded takedown screw hole is configured to attach the receiver to the stock.

In another respect, disclosed is a firearm action component comprising: a receiver, wherein the receiver comprises a bore with three or more guiding surfaces, one or more threaded securing holes, and a receiver indexing flat; a trigger unit removably attached to the receiver; a barrel removably attached to the receiver; wherein the barrel comprises: a tenon, one or more anchor points, and a barrel indexing flat; and one or more securing screws; wherein the receiver indexing flat is configured to index with the barrel indexing flat, wherein the tenon is configured to make contact with two of the three or more guiding surfaces of the bore, and wherein the one or more securing screws threaded and tightened into the one or more threaded securing holes are configured to secure the barrel to the receiver.

In yet another respect, disclosed is a method of securing a barrel to a receiver, the method comprising: inserting the barrel into the receiver, wherein the receiver comprises a bore with three or more guiding surfaces, one or more threaded securing holes, and a receiver indexing flat and wherein the barrel comprises: a tenon, one or more anchor points, and a barrel indexing flat; making contact between the tenon and the three or more guiding surfaces of the bore; indexing the barrel indexing flat with the receiver indexing flat; threading one or more securing screws into the one or more threaded securing holes; and tightening the one or more securing screws onto the one or more anchor points in order to secure the tenon of the barrel against two of the three or more guiding surfaces.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 1:
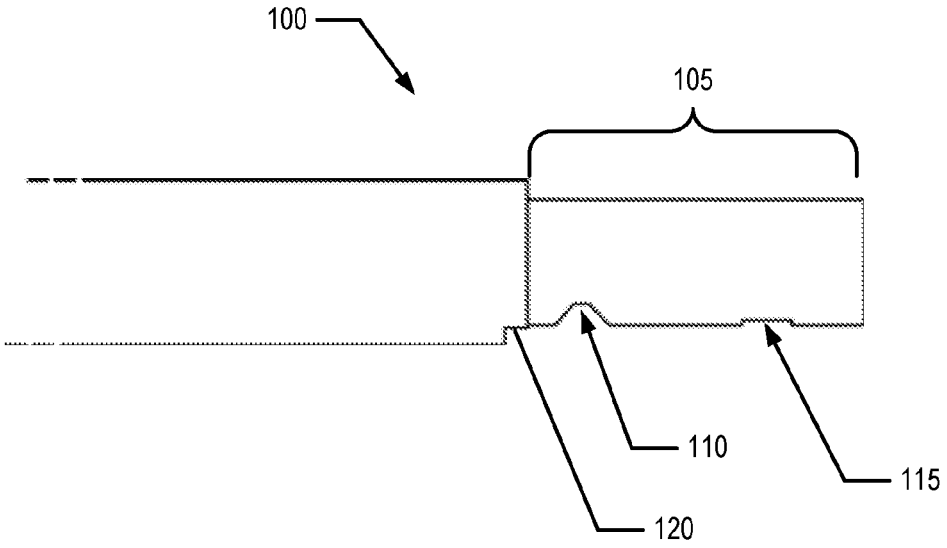
FIG. 1 is a side view of a barrel, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

The barrel/receiver attachments of 10/22 rifles are prone to loose fit, misalignment, improper indexing, and barrel droop. These problems are a result of: the receiver having a cylindrical bore for accommodating the cylindrical barrel tenon; the barrel tenon having a short length into which to be inserted into the receiver; the off axis clamping of the barrel tenon, and no indexing of the barrel. In order to properly attach the cylindrical barrel tenon to the cylindrical bore of the receiver, an interference fit or press fit is required. Thus, the barrel tenon must be oversized relative to the cylindrical bore of the receiver. Unfortunately, this interference fitting is prone to misalignment and indexing issues and additionally, a greater force is required to remove the barrel from the receiver.

In some barrel/receiver attachments of 10/22 rifles, the barrel is supported and aligned by the barrel's 0.75 inch length tenon. For a 20 inch barrel, which may weigh up to 3.25 pounds, the short tenon length of 0.75 inches is not adequate to support the barrel. Having a barrel nearly 27 times longer than the tenon results in misalignment and barrel droop.

In some barrel/receiver attachments of 10/22 rifles, an off axis barrel clamping method is used to secure the barrel to the receiver. The off axis clamping pulls downward on the barrel and causes the joint between the barrel tenon and receiver to bend, thus further misaligning the barrel's bore and sight plane.

Lastly, in some barrel/receiver attachments of 10/22 rifles, the indexing of the barrel extractor slot and barrel sights is set visually. Since the barrel is interference fit into the receiver, the visual indexing is difficult to accomplish.

The embodiment or embodiments described herein solve these problems and others by proposing a new innovative system for joining a barrel to the receiver of a firearm.

FIG. 1 is a side view of a barrel, in accordance with some embodiments.

In some embodiments, the barrel 100, with an approximate overall length of 20.0 inches, comprises a tenon 105 having a length of approximately 1.875 inches, a first anchor point 110, a second anchor point 115, and a barrel indexing flat 120. The barrel tenon in this embodiment is 250% longer than the typical 0.75 inch barrel tenon. The longer barrel tenon improves the alignment and support of the barrel into the receiver. The two anchor points 110, 115 provide locations where securing screws are capable of pressing the barrel rearward and upward into contact and guiding surfaces of a receiver (shown in FIG. 3). In this embodiment, the first anchor point 110 comprises a v-groove cut into the body of the tenon 105 and the second anchor point 115 comprises a straight-groove cut into the body of the tenon 105. The barrel indexing flat 120 provides a location for indexing to a receiver indexing flat in order to insure accurate rotational indexing of the barrel relative to the receiver (shown in FIG. 3).

Figure 2:
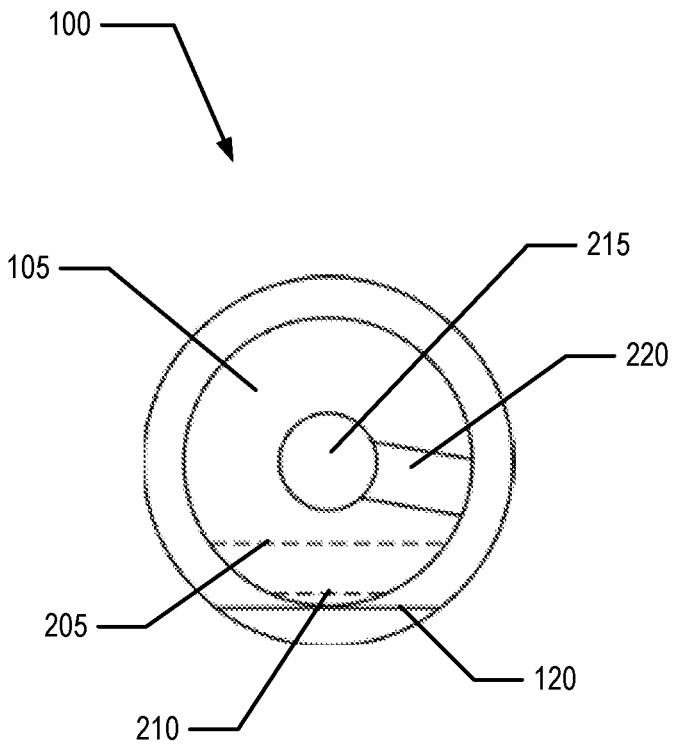
FIG. 2 is a proximal end view of the barrel, in accordance with some embodiments.

FIG. 2 is a proximal end view of the barrel, in accordance with some embodiments.

In some embodiments, the barrel 100 comprises the tenon 105 and the barrel indexing flat 120. The dashed line 205 indicates the top edge of the first anchor point 110 into the tenon 105 and the dashed line 210 indicates the surface of the second anchor point 115 within the tenon 105. The chamber 215 and extractor slot 220, which extends from the chamber through the tenon, are also shown in this view.

Figure 3:
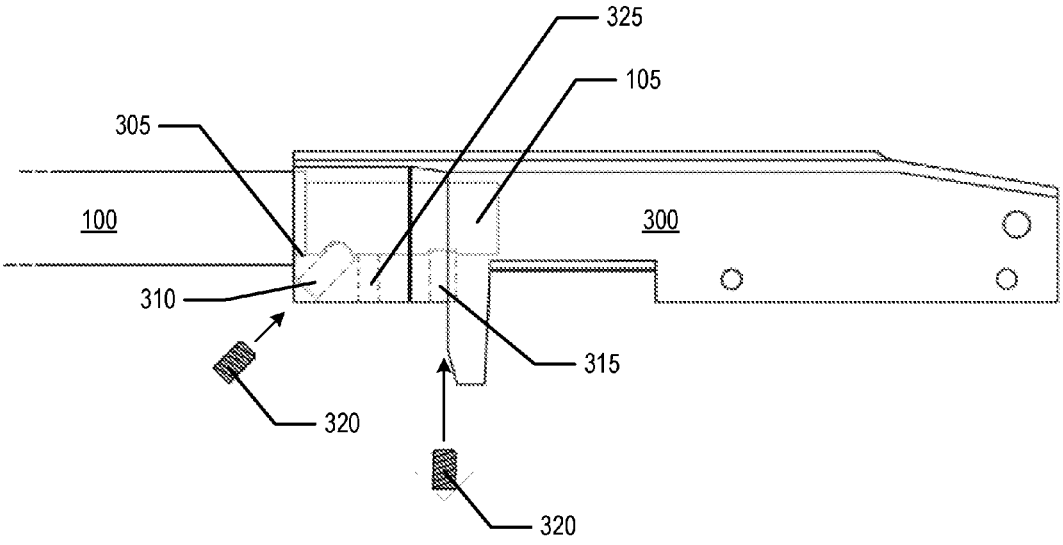
FIG. 3 is a side view of the barrel attached to a receiver, in accordance with some embodiments.

FIG. 3 is a side view of the barrel attached to a receiver, in accordance with some embodiments.

Figure 4:
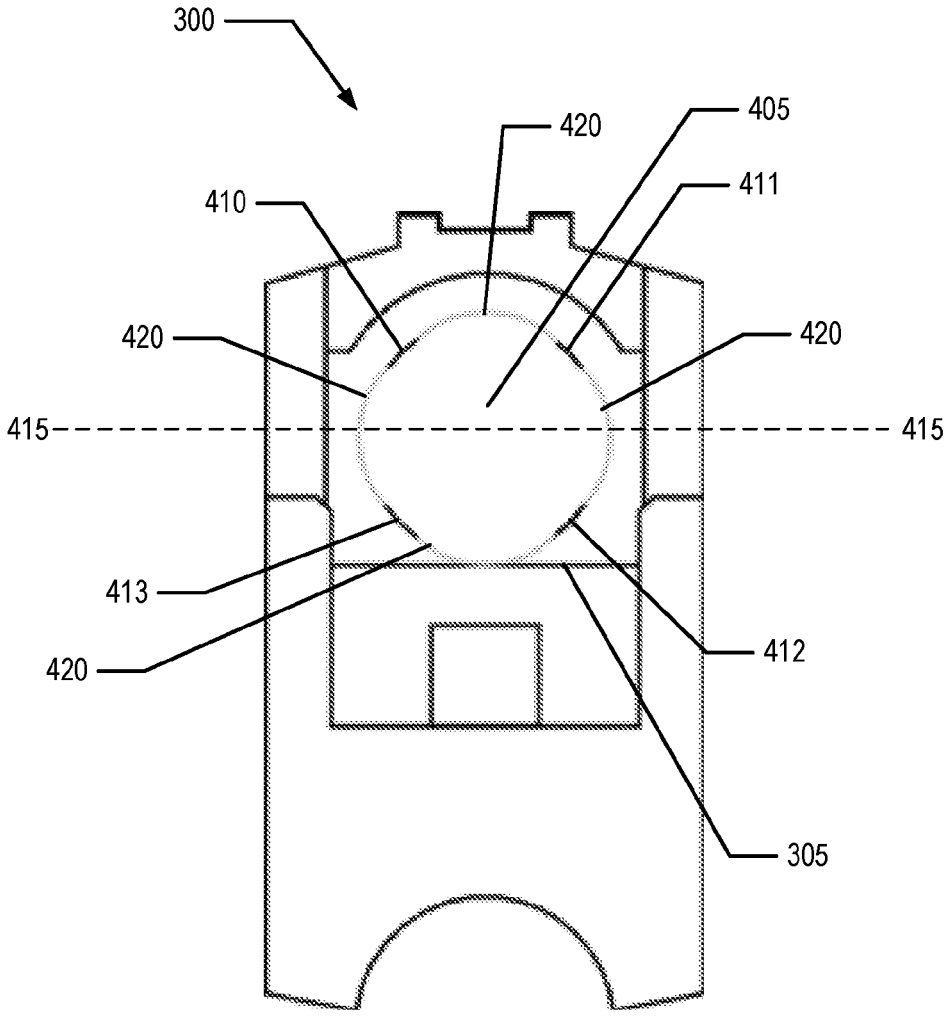
FIG. 4 is a proximal end view of the receiver, in accordance with some embodiments.
Figure 5:
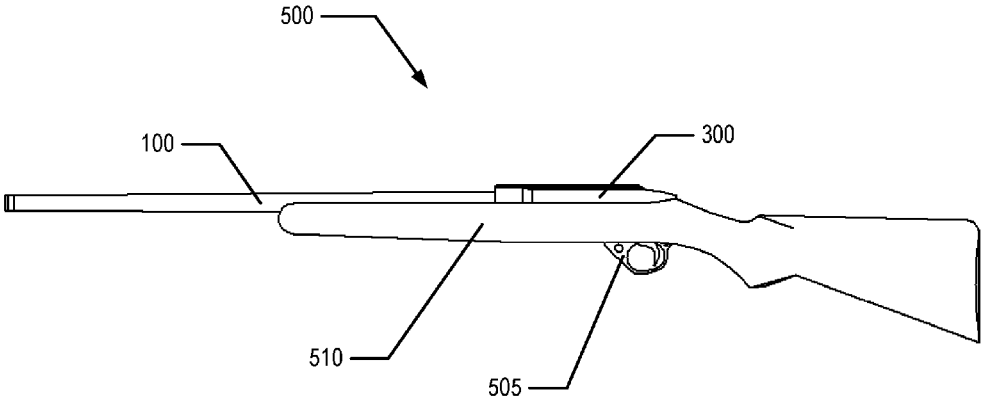
FIG. 5 is a side view of a firearm, in accordance with some embodiments.

In some embodiments, the receiver 300 comprises a bore long enough to accommodate the tenon 105 of the barrel 100, a receiver indexing flat 305, a first securing threaded hole 310, a second securing threaded hole 315, and multiple contact and guiding surfaces (shown in FIG. 4). Having a bore in the receiver long enough to accommodate the longer tenon of the barrel, improves the alignment and support of the barrel. The receiver indexing flat 305 indexes to the barrel indexing flat. This indexing ensures accurate rotational indexing of the barrel relative to the receiver. Securing screws 320 are threaded into the two threaded securing holes 310, 315 to press the barrel rearward and upward into two contact surfaces of the receiver, resulting in repeatable, rapid, and vibration free attachment of the barrel into the receiver. The multiple contact and guiding surfaces eliminate the need for an interference fit between the barrel and the receiver and insure accurate alignment of the barrel and sighting system. The threaded takedown screw hole 325 is also shown in this view. The threaded takedown screw hole is used to hold the firearm action components in the stock, as illustrated in FIG. 5.

FIG. 4 is a proximal end view of the receiver, in accordance with some embodiments.

In some embodiments, the receiver 300 comprises a bore 405 with multiple contact and guiding surfaces. In this embodiment, there are four guiding surfaces 410, 411, 412, and 413. The length of each of the guiding surfaces along the bore of the receiver equals the length of the tenon of the barrel. The midlines of the four guiding surfaces 410, 411, 412, and 413 are positioned +45 degrees and −45 degrees relative to the illustrated axis 415. The radius of curvature of the bore between the four guiding surfaces 420 is slightly larger than the radius of curvature of the four guiding surfaces 410, 411, 412, and 413. When the tenon of the barrel is inserted into the bore of the receiver, the four guiding surfaces 410, 411, 412, and 413 along with the barrel indexing flat and receiver indexing flat help to rotationally align and support the barrel to the receiver. The securing screws 320 are then tightened against the first anchor point 110 and the second anchor point 115, resulting in the contacting of the tenon to two of the guiding surfaces opposite the tenon 410 and 411. Thus making it possible to repeatedly and accurately attach the barrel to the receiver. In some embodiments, the diameter of the bore, at the four guiding surfaces, is oversized by 0.001 inches to 0.002 inches relative to the diameter of the tenon to allow the barrel to be inserted into the receiver with ease. The multiple contact and guiding surfaces eliminate the need for an interference fit between the tenon of the barrel and the receiver and insure accurate alignment of the barrel and sighting system. The receiver indexing flat 305 is also shown in this view.

In some embodiments, there are three guiding surfaces. In such an embodiment, two of the guiding surfaces would be used as contact reference surfaces when the securing screws are tightened.

FIG. 5 is a side view of a firearm, in accordance with some embodiments.

In some embodiments, firearm 500 comprises the barrel 100, the receiver 300, a trigger unit 505, and stock 510. The stock 510 is attached to the receiver 300 with a takedown screw threaded into the threaded takedown screw hole 325 as illustrated in FIG. 3. The barrel 100 is attached to the receiver 300 with securing set screws 320 threaded into the first securing threaded hole 310 and second securing threaded hole 315 as illustrated in FIG. 3. The second securing threaded hole is aligned parallel with the threaded takedown screw hole in order to prevent interference between the second securing screw and the takedown screw. In this embodiment, it is possible to remove and accurately replace the barrel without having to remove the firearm action, receiver or trigger unit, from the stock.

Figure 6:
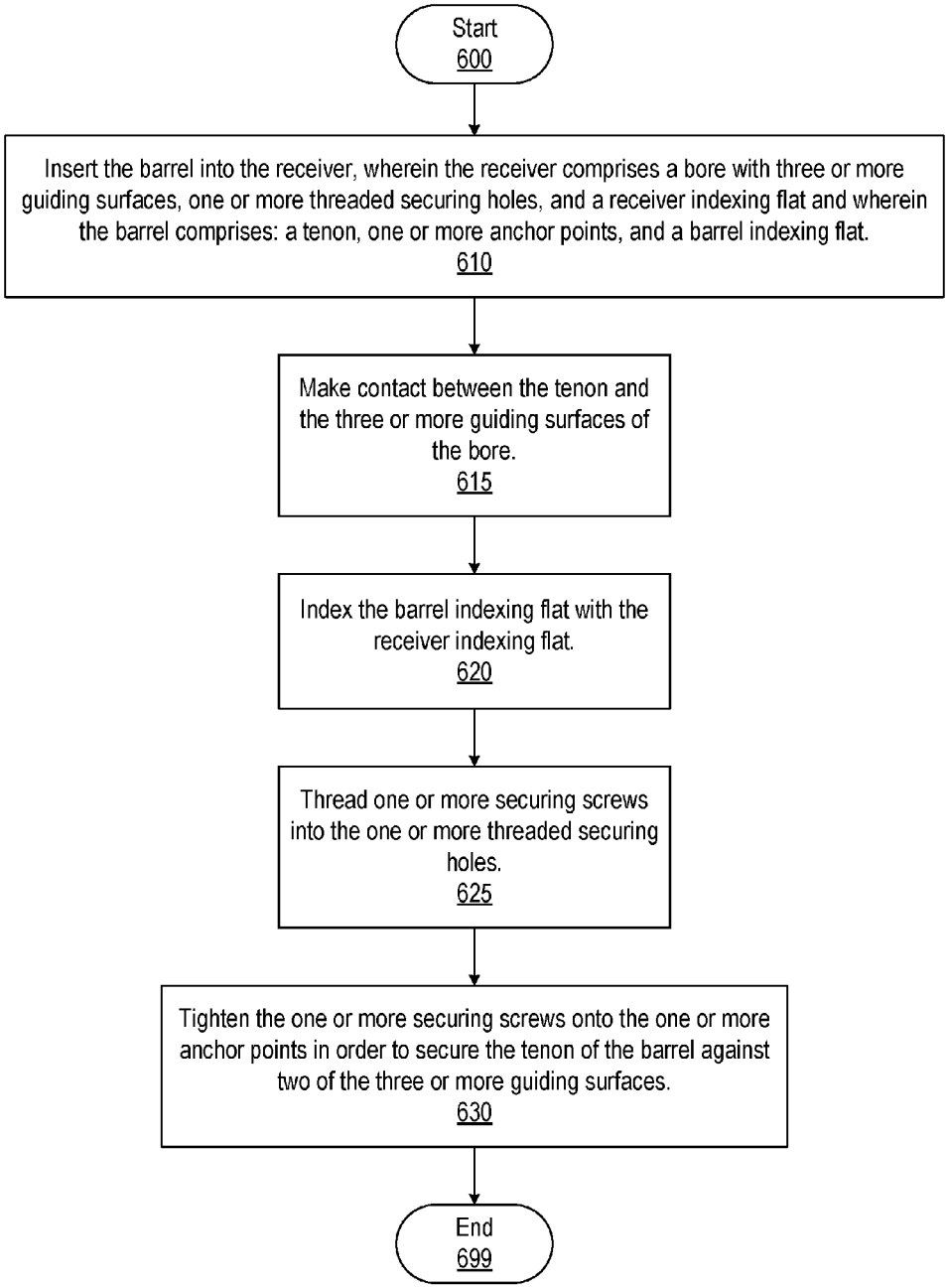
FIG. 6 is a flow diagram illustrating a method for securing a barrel to a receiver of a firearm, in accordance with some embodiments.

FIG. 6 is a flow diagram illustrating a method for securing a barrel to a receiver of a firearm, in accordance with some embodiments.

In some embodiments, the method illustrated in FIG. 6 may be performed by one or more of the devices illustrated in FIG. 1, FIG. 2, FIG. 3, FIG. 4, and FIG. 5. Processing begins at 600 whereupon, at block 610, the barrel is inserted into the receiver, wherein the receiver comprises a bore with three or more guiding surfaces, one or more threaded securing holes, and a receiver indexing flat and wherein the barrel comprises: a tenon, one or more anchor points, and a barrel indexing flat. At block 615, contact is made between the tenon and the three or more guiding surfaces of the bore. At block 620, the barrel indexing flat is indexed with the receiver indexing flat. Next, at block 625, one or more securing screws are threaded into the one or more threaded securing holes. Finally, the one or more securing screws are tightened onto the one or more anchor points. Processing subsequently ends at 699.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims. Appl. No. 15/147,796

The invention claimed is:

1. A firearm comprising:

a stock;

a receiver, wherein the receiver comprises a bore with three or more guiding surfaces, one or more threaded securing holes, a threaded takedown screw hole, and a receiver indexing flat;

a trigger unit removably attached to the receiver;

a barrel removably attached to the receiver, wherein the barrel comprises: a tenon, one or more anchor points, and a barrel indexing flat;

one or more securing screws; and a takedown screw;

wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, wherein the takedown screw threaded and tightened into the threaded takedown screw hole is configured to attach the receiver to the stock, wherein one of the one or more anchor points comprises a v-groove cut into the tenon, and wherein one of the one or more threaded securing holes is configured to allow one of the one or more securing screws to tighten against one of the flat surfaces of the v-groove cut.

2. A firearm comprising:

a stock;

a receiver, wherein the receiver comprises a bore with three or more guiding surfaces, one or more threaded securing holes, a threaded takedown screw hole, and a receiver indexing flat;

a trigger unit removably attached to the receiver;

a barrel removably attached to the receiver; wherein the barrel comprises: a tenon, one or more anchor points, and a barrel indexing flat;

one or more securing screws; and a takedown screw;

wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, wherein the takedown screw threaded and tightened into the threaded takedown screw hole is configured to attach the receiver to the stock, wherein one of the one or more anchor points comprises a straight-groove cut into the tenon, and wherein one of the one or more threaded securing holes is configured to allow one of the one or more securing screws to tighten against the straight-groove cut without interfering with the takedown screw.

3. The firearm of claim 2, wherein the length of the tenon is at least 9% of the length of the barrel.

4. The firearm of claim 2, wherein the length of the tenon is approximately 1.875 inches.

5. The firearm of claim 2, wherein the length of the barrel is approximately 20.0 inches.

6. A firearm comprising:

a stock;

a receiver, wherein the receiver comprises a bore with three or more guiding surfaces, one or more threaded securing holes, a threaded takedown screw hole, and a receiver indexing flat;

a trigger unit removably attached to the receiver;

a barrel removably attached to the receiver; wherein the barrel comprises: a tenon, one or more anchor points, and a barrel indexing flat;

one or more securing screws; and a takedown screw;

wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, wherein the takedown screw threaded and tightened into the threaded takedown screw hole is configured to attach the receiver to the stock, and wherein the length of each of the three or more guiding surfaces is approximately 1.875 inches.

7. A firearm action component comprising:

a receiver, wherein the receiver comprises a bore with three or more guiding surfaces, one or more threaded securing holes, and a receiver indexing flat;

a trigger unit removably attached to the receiver;

a barrel removably attached to the receiver; wherein the barrel comprises: a tenon, one or more anchor points, and a barrel indexing flat; and one or more securing screws;

wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, wherein one of the one or more anchor points comprises a v-groove cut into the tenon, and wherein one of the one or more threaded securing holes is configured to allow one of the one or more securing screws to tighten against one of the flat surfaces of the v-groove cut.

8. A firearm action component comprising:

a receiver, wherein the receiver comprises a bore with three or more guiding surfaces, one or more threaded securing holes, and a receiver indexing flat;

a trigger unit removably attached to the receiver;

a barrel removably attached to the receiver; wherein the barrel comprises: a tenon, one or more anchor points, and a barrel indexing flat; and one or more securing screws;

wherein the receiver indexing flat is configured to index with the barrel indexing flat, wherein the tenon is configured to make contact with two of the three or more guiding surfaces of the bore, wherein the one or more securing screws threaded and tightened into the one or more threaded securing holes are configured to secure the barrel to the receiver, wherein one of the one or more anchor points comprises a straight-groove cut into the tenon, and wherein one of the one or more threaded securing holes is configured to allow one of the one or more securing screws to tighten against the straight-groove cut.

9. The firearm action component of claim 8, wherein the length of the tenon is at least 9% of the length of the barrel.

10. The firearm action component of claim 8, wherein the length of the tenon is approximately 1.875 inches.

11. The firearm action component of claim 8, wherein the length of the barrel is approximately 20.0 inches.

12. A firearm action component comprising:

a receiver, wherein the receiver comprises a bore with three or more guiding surfaces, one or more threaded securing holes, and a receiver indexing flat;

a trigger unit removably attached to the receiver;

a barrel removably attached to the receiver; wherein the barrel comprises: a tenon, one or more anchor points, and a barrel indexing flat; and one or more securing screws;

wherein the receiver indexing flat is configured to index with the barrel indexing flat, wherein the tenon is configured to make contact with two of the three or more guiding surfaces of the bore, wherein the one or more securing screws threaded and tightened into the one or more treaded securing holes are configured to secure the barrel to the receiver, and wherein the length of each of the three or more guiding surfaces is approximately 1.875 inches.

13. The firearm of claim 1, wherein the length of the tenon is at least 9% of the length of the barrel.

14. The firearm of claim 1, wherein the length of the tenon is approximately 1.875 inches.

15. The firearm of claim 1, wherein the length of the barrel is approximately 20.0 inches.

16. The firearm action component of claim 7, wherein the length of the tenon is at least 9% of the length of the barrel.

17. The firearm action component of claim 7, wherein the length of the tenon is approximately 1.875 inches.

18. The firearm action component of claim 7, wherein the length of the barrel is approximately 20.0 inches.

* * * * *